US006435678B1

(12) United States Patent
Erdtmann et al.

(10) Patent No.: US 6,435,678 B1
(45) **Date of Patent: *Aug. 20, 2002**

(54) WATERFAST INK JET IMAGES TREATED WITH HARDENERS

(75) Inventors: David Erdtmann; Charles E. Romano, both of Rochester, NY (US)

(73) Assignee: Eastman Kodak Company, Rochester, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/083,871

(22) Filed: May 22, 1998

(51) Int. Cl.[7] ..... B41J 2/01
(52) U.S. Cl. ..... 347/101; 101/491
(58) Field of Search ..... 347/105, 106, 347/96, 98, 101; 427/421, 258, 261, 265, 337, 340, 343; 428/411.1, 195, 500, 520; 101/491

(56) References Cited

U.S. PATENT DOCUMENTS

| | | | | |
|---|---|---|---|---|
| 2,059,817 A | | 11/1936 | Sheppard et al. | |
| 2,992,109 A | | 7/1961 | Allen | |
| 3,232,763 A | | 2/1966 | Burness | |
| 3,304,179 A | | 2/1967 | Field et al. | |
| 3,360,372 A | | 12/1967 | Burness et al. | |
| 3,490,911 A | | 1/1970 | Burness et al. | |
| 3,565,632 A | | 2/1971 | Mills et al. | |
| 3,635,718 A | | 1/1972 | Froehlich et al. | |
| 3,640,720 A | | 2/1972 | Cohen | |
| 3,642,486 A | | 2/1972 | Burness et al. | |
| 3,689,724 A | | 9/1972 | Labude | |
| 3,762,926 A | | 10/1973 | Himmelmann et al. | |
| 4,419,388 A | * | 12/1983 | Sugiyama et al. | 427/288 |
| 4,597,794 A | | 7/1986 | Ohta et al. | |
| 4,649,064 A | * | 3/1987 | Jones | 427/256 |
| 5,085,698 A | | 2/1992 | Ma et al. | |
| 5,172,133 A | | 12/1992 | Suga et al. | |
| 5,320,897 A | * | 6/1994 | Kondo et al. | 428/195 |
| 5,478,381 A | * | 12/1995 | Ohiwa et al. | 106/21 A |
| 5,552,182 A | * | 9/1996 | Scarpetti | 427/256 |
| 5,677,067 A | * | 10/1997 | Kojima et al. | 428/478.2 |
| 5,753,360 A | * | 5/1998 | Jones et al. | 428/323 |
| 5,756,226 A | * | 5/1998 | Valentini et al. | 428/704 |
| 5,803,959 A | * | 9/1998 | Johnson et al. | 106/31.75 |
| 5,853,470 A | * | 12/1998 | Martin et al. | 106/31.86 |
| 5,877,796 A | * | 3/1999 | Tsuchiya et al. | 347/105 |
| 5,928,789 A | * | 7/1999 | Chen et al. | 428/413 |
| 5,942,335 A | * | 8/1999 | Chen et al. | 428/500 |
| 5,965,252 A | * | 10/1999 | Santo et al. | 428/329 |
| 5,977,018 A | * | 11/1999 | Moreland | 503/201 |
| 6,003,989 A | * | 12/1999 | Chen et al. | 347/105 |
| 6,010,790 A | * | 1/2000 | Chen et al. | 428/411.1 |
| 6,057,026 A | * | 5/2000 | Tsuchiya et al. | 428/195 |
| 6,068,373 A | * | 5/2000 | Chen et al. | 347/105 |
| 6,161,929 A | * | 12/2000 | Erdtmann et al. | 347/101 |

FOREIGN PATENT DOCUMENTS

| | | | | |
|---|---|---|---|---|
| WO | 98/30392 | * | 7/1998 | 347/105 |

OTHER PUBLICATIONS

The Theory of the Photographic Process, 4th Ed., T.H. James, 1977 Macmillan Publishing Co. pp. 77–87.

Research Disclosure, vol. 365, Sep. 1994, Item 36544, II, B. Hardeners.

* cited by examiner

*Primary Examiner*—Eugene Eickholt
(74) *Attorney, Agent, or Firm*—Harold E. Cole

(57) ABSTRACT

A method of improving the durability of an ink jet ink image comprising the steps of: a) providing an ink jet ink receiving layer containing a hardener; b) image-wise depositing pigment-based ink jet ink on the hardener-containing ink receiving layer; and then c) applying to the ink receiving layer a solution comprising a hardener that is the same or different from the hardener in the ink receiving layer.

22 Claims, No Drawings

WATERFAST INK JET IMAGES TREATED WITH HARDENERS

FIELD OF THE INVENTION

This invention relates to methods and formulations that improve the performance of aqueous inks which utilize pigments as colorants and which are useful for ink jet printing applications. Specifically, this invention relates to incorporating hardeners into ink receiving layers (IRL's), printing the above receivers with pigmented inks, and then treating the printed image with a solution which also contain hardeners.

BACKGROUND OF THE INVENTION

The formulations and methods employed in ink jet imaging involve the application of liquid ink droplets in a pixel-by-pixel manner to an ink-receiving element. There are numerous schemes that may be utilized to control the deposition of ink droplets on the image-recording element to yield the desired image. In one process, known as continuous ink jet, a continuous stream of droplets is charged and deflected in an imagewise manner onto the surface of the image-recording element, while unimaged droplets are caught and returned to the ink sump. In another process, known as drop-on-demand ink jet, individual ink droplets are projected as needed onto the image-recording element to form the desired image. Common methods of controlling the projection of ink droplets in drop-on-demand printing include piezoelectric transducers and thermal bubble formation.

The inks used in the various ink jet printers can be classified as either dye-based or pigment-based. A dye is a colorant, which is molecularly dispersed or solvated by the carrier medium. The carrier medium can be a liquid or a solid at room temperature. A commonly used carrier medium is water or a mixture of water and organic cosolvents. Each individual dye molecule is surrounded by molecules of the carrier medium. In dye-based inks, no particles are observable under the microscope. Although there have been many recent advances in the art of dye-based ink jet inks, such inks still suffer from deficiencies such as low optical densities on plain paper and poor lightfastness. When water is used as the carrier medium, such inks also generally suffer from poor waterfastness.

Pigment-based inks have been gaining in popularity as a means of addressing these limitations. In pigment-based inks, the colorant exists as discrete particles. These pigment particles are usually treated with addenda known as dispersants or stabilizers, which serve to keep the pigment particles from agglomerating and/or settling out. Pigment-based inks suffer from a different set of deficiencies than dye-based inks. One deficiency is related to the observation that pigment-based inks interact differently with specially coated papers and films, such as the transparent films used for overhead projection and the glossy papers and opaque white films used for high quality graphics and pictorial output. In particular, it has been observed that pigment-based inks produce imaged areas that are entirely on the surface of coated papers and films. This results in images which have poor dry and wet adhesion properties, resulting in images which can be easily smudged.

Commonly owned U.S. patent application Ser. No. 08/847,858, filed Apr. 28, 1997, entitled "Pigmented Ink Jet Inks Containing Aldehydes" of Martin et al., and U.S. patent application Ser. No. 08/896,520 filed Apr. 28, 1997, entitled "Pigmented Ink Jet Inks Containing Olefins" of Martin et al., disclose ink jet ink formulations containing compounds with aldehyde, blocked aldehyde and active olefinic functional groups. However, these references do not teach the use of a solution that is separate and distinct from the ink, nor do they teach treating the ink receiver to improve waterfastness of the image.

SUMMARY OF THE INVENTION

The present invention discloses that improved waterfastness, and wet adhesion are observed when gelatin and/or cross-linkable polymeric coated papers or films containing one or more hardeners are printed with a pigmented ink jet ink and the printed image is then treated with a solution containing one or more hardeners. Hardening agents are defined as any additive which causes chemical cross-linking. It is advantageous to cross-link the coating prior to applying the hardener solution to the printed image to prevent the image from migrating or running when the hardener solution is applied over it. The hardener solution can be added in a variety of ways, for example, via a printhead, spray-bar, or by submersion in a hardener bath. Methods and apparatuses for applying the hardener solution are disclosed in U.S. patent application Ser. No. 09/083,673, filed May, 22, 1998, entitled "Printing Apparatus With Spray Bar For Improved Durability" of Wen et al., U.S. patent application Ser. No. 09/083,070, filed May 22, 1998, entitled "Printing Apparatus With Processing Tank" of Wen et al., and U.S. patent application Ser. No. 09/083,876, filed May 22, 1998, entitled "Ink Jet Printing Apparatus With Print Head For Improved Image Quality" of Wen et al., The present invention provides a method of improving the durability of an ink jet ink image comprising the steps of:

a) providing an ink jet ink receiving layer containing hardener;

b) image-wise depositing pigment-based ink jet ink on the hardener-containing ink receiving layer; and then c) applying to the ink receiving layer a solution comprising a hardener that is the same or different from the hardener in the ink receiving layer.

Also provided is an ink jet ink receiver comprising:

a support;

on the support, an ink jet ink receiving layer containing a hardener;

on the ink receiving layer, an image formed by pigmented ink jet ink deposited thereon; and a solution applied to the ink receiving layer, said solution comprising a hardener that is the same or different from the hardener in the ink receiving layer.

Thus, the present invention relates to inkjet receivers containing one or more hardeners, and treatment of the printed image with a hardener solution where the solution contains one or more hardeners. When hardener solutions of the present invention are applied after printing with pigmented inks onto glossy papers and films containing an imaging layer consisting of gelatin or cross-linkable polymers, the inkjet images exhibit excellent waterfastness, wet adhesion, and image quality properties throughout the image.

DETAILED DESCRIPTION OF THE INVENTION

The hardeners in the ink-receiving layer and in the hardener solution may include organic hardener compounds, inorganic hardener compounds or combinations of both.

Concentrations of hardeners in the ink-receiving layer can range from 0.10 to 5.0 weight percent, preferably 0.10 to 3.0 weight percent. Concentrations of hardeners in the hardener solution can range from 0.10 to 5.0 weight percent, preferably 0.25 to 2.0 weight percent.

Preferred hardeners include formaldehyde and compounds that contain two or more aldehyde functional groups such as glyoxal, gluteraldehyde and the like. Other preferred hardeners include compounds that contain blocked aldehyde functional groups such as aldehydes of the type tetrahydro-4-hydroxy-5-methyl-2(1H)-pyrimidinone polymers (Sequa SUNREZ® 700), polymers of the type having a glyoxal polyol reaction product consisting of 1 anhydroglucose unit: 2 glyoxal units (SEQUAREZ® 755 obtained from Sequa Chemicals, Inc.), DME-Melamine non-fomaldehyde resins such as Sequa CPD3046-76 obtained from Sequa Chemicals Inc., 2,3-dihydroxy-1,4-dioxane (DHD), and the like. Blocked hardeners are substances, usually derived from the active hardener, that release the active compound under appropriate conditions (The Theory of the Photographic Process, $4^{th}$ Edition, T. H. James, 1977, Macmillan Publishing CO., page 81). All are employed at concentrations ranging from 0.10 to 5.0 weight percent of active ingredients in the solution and/or in the ink-receiving layer.

Other preferred hardeners are compounds that contain active olefinic functional groups such as bis-(vinylsulfonyl)-methane (BVSM), bis-(vinylsulfonyl-methyl)ether (BVSME), 1,3,5-triacryloylhexahydro-s-triazine, and the like. In the context of the present invention, active olefinic compounds are defined as compounds having two or more olefinic bonds, especially unsubstituted vinyl groups, activated by adjacent electron withdrawing groups (The Theory of the Photographic Process, $4^{th}$ Edition, T. H. James, 1977, Macmillan Publishing Co., page 82). All are employed at concentrations ranging from 0.10 to 5.0 weight percent of active ingredients in the solution and/or in the ink-receiving layer.

Still other preferred additives are inorganic hardeners such as aluminum salts, especially the sulfate, potassium and ammonium alums, ammonium zirconium carbonate, chromium salts such as chromium sulfate and chromium alum, and salts of titanium dioxide, zirconium dioxide, and the like. All are employed at concentrations ranging from 0.10 to 5.0 weight percent of active ingredients in the solution and/or in the ink-receiving layer. Inorganic hardeners are preferably used with gelatin receivers.

Combinations of organic and inorganic hardeners may also be used. Most preferred is the combination of chrome alum (chromium(III)potassium sulfate dodecahydrate) or aluminum sulfate and 2,3-dihydroxy-1,4-dioxane (DHD) at total hardener concentrations ranging from 0.10 to 5.0 wt. Most preferred is the combination of aluminum sulfate and 2,3-dihydroxy-1,4-dioxane (DHD) having a total hardener concentration ranging between 0.25 and 2.0 weight percent of active ingredients in the hardener solution and/or in the ink-receiving layer.

Besides the hardener, the ink-receiving layer may contain varying levels of matting agents for the purpose of controlling gloss, friction, and/or fingerprint resistance, surfactant (s) to improve coatability and to adjust the surface tension of the dried coating, anti-oxidants, UV absorbing compounds, light stabilizers, and the like.

Inks useful for ink jet recording processes generally comprise at least a mixture of a solvent and a colorant. The preferred solvent is deionized water, and the colorant is either a pigment or a dye. Pigments are often preferred over dyes because they generally offer improved waterfastness and lightfastness on plain paper.

Pigmented inks are most commonly prepared in two steps:

1. a pigment milling step in which the as-received pigment is deaggregated into its primary particle size, and
2. a dilution step in which the pigment mill grind is converted into a useable ink.

Processes for preparing pigmented ink jet inks involve blending the pigment, an additive known as a stabilizer or dispersant, a liquid carrier medium, grinding media, and other optional addenda such as surfactants and defoamers. This pigment slurry is then milled using any of a variety of hardware such as ball mills, media mills, high-speed dispersers, and roll mills.

In the practice of the present invention, any of the known pigments can be used. The exact choice of pigment will depend upon the specific color reproduction and image stability requirements of the printer and application. For a list of pigments useful in ink jet inks, see U.S. Pat. No. 5,085,698, column 7, line 10 through column 8, line 48.

The liquid carrier medium can also vary widely and again will depend on the nature of the ink jet printer for which the inks are intended. For printers which use aqueous inks, water, or a mixture of water with miscible organic co-solvents, is the preferred carrier medium.

The dispersant is another important ingredient in the mill grind. Although there are many know dispersants known in the art, the best dispersant will be a function of the carrier medium and often varies from pigment to pigment. Preferred dispersants for aqueous ink jet inks include sodium dodecyl sulfate, acrylic and styrene-acrylic copolymers, such as those disclosed in U.S. Pat. Nos. 5,085,698 and 5,172,133, and sulfonated styrenics, such as those disclosed in U.S. Pat. No. 4,597,794. Our most preferred dispersants are salts of oleyl methyl tauride.

In the dilution step, other ingredients are also commonly added to pigmented ink jet inks. Cosolvents (0–20 wt %) are added to help prevent the ink from drying out or crusting in the orifices of the printhead or to help the ink penetrate the receiving substrate, especially when the substrate is a highly sized paper. Preferred cosolvents for the inks of the present invention are glycerol, ethylene glycol, diethylene glycol, propylene glycol, 2-methyl-2,4-pentanediol and mixtures thereof, at overall concentrations ranging from 5 to 20 wt %.

A biocide (0.0001–1.0 wt %) may be added to prevent unwanted microbial growth, which may occur in the ink over time. A preferred biocide for the inks of the present invention is Proxel GXL™ (1,2-benzisothiozolin-3-one, obtained from Zeneca Colours) at a final concentration of 0.005–0.5 wt %.

Additional additives, which may optionally be present in ink jet inks, include thickeners, conductivity enhancing agents, anti-kogation agents, drying agents, and defoamers.

In the context of the present invention, the ink-receiving layer is cross-linked with a hardening agent. After the ink-receiving-layer has been printed with the pigmented ink, the ink receiving layer is treated with a solution containing one or more hardeners. Images with excellent waterfastness, wet adhesion, and image quality properties are produced using the above method and formulations.

Besides those already listed above, it is contemplated that other aldehyde containing compounds that are effective hardeners are also useful in the practice of this invention. Some compounds known to be effective hardeners are 3-hydroxybutyraldehyde (U.S. Pat. No. 2,059,817), crotonaldehyde, the homologous series of dialdehydes ranging from glyoxal to adipaldehyde, diglycolaldehyde (U.S. Pat. No. 3,304,179) various aromatic dialdehydes (U.S. Pat. No. 3,565,632 and U.S. Pat. No. 3,762,926), and polymeric dialdehydes such as dialdehyde starch and dialdehyde derivatives of plant gums. Most preferred are formaldehyde, glutaraldehyde, succinaldehyde, and glyoxal.

Likewise, it is also contemplated that other hardeners may be useful in he context of this invention. Some compounds known to be effective hardeners are blocked aldehydes such as 2,3-dihydroxy-1,4-dioxane (DHD) and its derivatives, acetates of the dialdehydes and hemiacetals, various bisulfite adducts, 2,5-dimethoxytetrahydrofuran, and N-methylol compounds obtained from the condensation of formaldehyde with various aliphatic or cyclic amides, ureas, or nitrogen heterocycles. Most preferred is 2,3-dihydroxy-1,4-dioxane (DHD).

It is contemplated that compounds with active olefinic functionality, that are effective hardeners are also useful in the practice of this invention. Some compounds known to be effective hardeners are divinyl ketone, resorcinol bis (vinylsulfonate) (U.S. Pat. No. 3,689,274), 4,6-bis (vinylsulfonyl)-m-xylene (U.S. Pat. No. 2,994,611), bis (vinylsulfonylalkyl)ethers and amines (U.S. Pat. No. 3,642,486 and U.S. Pat. No. 3,490,911), 1,3,5-tris(vinylsulfonyl) hexahydro-s-triazine, diacrylamide (U.S. Pat. No. 3,635,718), 1,3-bis(acryloyl)urea (U.S. Pat. No. 3,640,720), N,N'-bismaleimides (U.S. Pat. No. 2,992,109) bisisomaleimides (U.S. Pat. No. 3,232,763), bis(2-acetoxyethyl)ketone (U.S. Pat. No. 3,360,372), and 1,3,5-triacryloylhexahydro-s-triazine. Blocked active olefins of the type bis(2-acetoxyethyl)ketone and 3,8-dioxodecane-1,10-bis (pyridinium perchlorate) may also be used. Most preferred is BVSM and BVSME.

It is further contemplated that other inorganic hardeners that are effective hardeners are also useful in the practice of this invention. Some compounds known to be effective hardeners include zirconium and titanium salts, chromium salts such as chromium sulfate and chromium alum, and aluminum salts, especially the sulfate potassium and ammonium alums. Most preferred is aluminum sulfate.

Other compounds which may act as hardeners include: acetylenes, azides, aziridines, carboxylic acid derivatives such as anhydrides, activated esters, and imido esters, epoxides such as glycidyl ethers and glyciylammonium salts, active halogen compounds, isocyanate adducts, diketones, methylol Melamines, oxazolines, organometallics such as Volan™ (a complex of methacrylic acid and chromium III chloride), peptide bond forming agents such as carbodiimides, isoxazoliumsalts, N-Carbamoylpyridinium salts, and 4-Amino-1-methylsulfonylpyridinium salts, sulfonate esters, s-Triazines, mucochloric acid, and polymeric hardeners. Some of these above listed hardeners might be better suited for one type of receiver than another. For example, they might work better with gelatin than with acetoacetylated PVA or other cross-linkable polymers. However, without undue experimentation one skilled in the art would be able to select the hardener most suited to the choice of receiver.

In addition there may be a synergistic effect from certain combinations of the above mentioned hardeners.

Additional related hardeners can be found in, The Theory of the Photographic Process, 4$^{th}$ Edition, T. H. James, 1977, Macmillan Publishing CO. pages 77–87, and in *Research Disclosure,* Vol. 365, Sep. 1994, Item 36544, II, B. Hardeners.

EXAMPLES

| Comparative Example A | |
|---|---|
| Mill Grind | |
| Polymeric beads, mean diameter of 50 μm (milling media) | 325.0 g |
| Bis(phthalocyanylalumino)tetra-Phenyldisiloxane (cyan pigment) Manufactured by Eastman Kodak | 35.0 g |
| Oleoyl methyl taurine, (OMT) sodium salt | 17.5 g |
| Deionized water | 197.5 g |
| Proxel GXL ™ (biocide from Zeneca) | 0.2 g |

The above components were milled using a high-energy media mill manufactured by Morehouse-Cowles Hochmeyer. The mill was run for 8 hours at room temperature. An aliquot of the above dispersion to yield 1.0 g pigment was mixed with 8.00 g diethylene glycol, and additional deionized water for a total of 50.0 g. This ink was filtered through 3-μm filter and introduced into an empty Hewlett-Packard 51626A print cartridge. Images were made with a Hewlett-Packard DeskJet™ 540 printer on medium weight resin coated paper containing an imaging layer.

The resin coated paper stock had been previously treated with a corona discharge treatment (CDT) and coated with an imaging layer consisting of about 800 mg/ft$^2$ of an acetoacetylated poly(vinylalcohol) (Gohsefimer Z-200, Nippon Gohsei.

Poor waterfastness and wet adhesion were observed throughout the image ($D_{max}$ and lower density areas). The pigmented ink image floated to the surface immediately when immersed in distilled water.

Comparative Example B

An ink was prepared in a similar manner as described in Comparative Example A except, the cyan pigment was replaced with 1.45 g of a quinacridone magenta pigment (pigment red 122) from Sun Chemical Co, 6.0 g of diethylene glycol was added to the ink, and additional deionized water for a total of 50 grams. The ink was printed as in Comparative Example A and poor waterfastness and wet adhesion was observed.

Comparative Example C

An ink was prepared and printed in the same manner as that described in Comparative Example A, except to the ink-receiving layer was added 2,3-dihydroxy-1,4-dioxane (DHD) obtained from Aldrich Chemicals at a concentration of 0.50 weight percent to total polymer.

Excellent waterfastness properties were observed in the 100% fill areas (92% density retention). Fair wet adhesion properties were observed in the 100% fill areas ($D_{max}$)(65% retention), and very poor wet adhesion (the image floated off the ink-receiving layer surface when immersed in water) were observed in the lower density areas.

Comparative Example D

An ink was prepared and printed in the same manner as that described in Comparative Example B, except to the ink-receiving layer was added 2,3-dihydroxy-1,4-dioxane (DHD) obtained from Aldrich Chemicals at a concentration of 0.50 weight percent to total polymer.

Good waterfastness properties were observed in the 100% fill areas (115% density retention, which indicates that the ink bleed throughout the image). Fair wet adhesion properties were observed in the 100% fill areas ($D_{max}$)(66% retention), and very poor wet adhesion (the image floated off the ink-receiving layer surface when immersed in water) were observed in the lower density areas.

Comparative Example E

An ink was prepared and printed in the same manner as that described in Example A.

A hardener solution was prepared consisting of 100.00 g of a 10.0% solution of Air Products Surfynol® 465, 75.00 g of 10 wt % solution of 2,3-dihydroxy-1,4-dioxane (DHD) obtained from Aldrich Chemicals to obtain a final hardener concentration of 0.75 wt %, and additional deionized water for a total of 1000 g. The pigmented ink image was submerged in this solution for approximately 5 seconds and allowed to dry.

Around the edges of the $D_{max}$ patch the pigmented ink began to peel off, however, where the image did not peel off (center of patch) good waterfastness properties were observed (87% density retention). In the lower density areas and thin lines ($1/32^{nd}$ of an inch) all of the image peeled off and ran down the paper without any physical abrasion (this was considered NG in Table 1).

Comparative Example F

An ink was prepared and printed in the same manner as that described in Example B.

A hardener solution was prepared consisting of 100.00 g of a 10.0% solution of Air Products Surfynol® 465, 75.00 g of 10 wt % solution of 2,3-dihydroxy-1,4-dioxane (DHD) obtained from Aldrich Chemicals to obtain a final hardener concentration of 0.75 wt %, and additional deionized water for a total of 1000 g. The pigmented ink image was submerged in this solution for approximately 5 seconds and allowed to dry.

Around the edges of the $D_{max}$ patch the pigmented ink began to peel off, however, where the image did not peel off (center of patch) very good waterfastness properties were observed (98% density retention). In the lower density areas and thin lines ($1/32^{nd}$ of an inch) all of the image peeled off and ran down the paper without any physical abrasion (this was considered NG in Table 1).

Example 1

An ink was prepared and printed in the same manner as that described in Comparative Example A, except to the ink-receiving layer was added 2,3-dihydroxy-1,4-dioxane (DHD) obtained from Aldrich Chemicals at a concentration of 0.50 weight percent to total ink-receiving layer polymer.

A hardener solution was prepared consisting of 100.00 g of a 10.0% solution of Air Products Surfynol® 465, 75.00 g of 10 wt % solution of 2,3-dihydroxy-1,4-dioxane (DHD) obtained from Aldrich Chemicals to obtain a final hardener concentration of 0.75 wt %, and additional deionized water for a total of 1000 g. The pigmented ink image was submerged in this solution for approximately 5 seconds and allowed to dry.

Good waterfastness properties were observed in the 100% fill areas (86% density retention). Good wet adhesion properties were observed in the 100% fill areas ($D_{max}$)(83% retention), and excellent wet adhesion was observed in the lower density areas (100% retention).

Example 2

An ink was prepared and printed in the same manner as that described in Comparative Example B, except to the ink-receiving layer was added 2,3-dihydroxy-1,4-dioxane (DHD) obtained from Aldrich Chemicals at a concentration of 0.50 weight percent to total ink-receiving layer polymer.

A hardener solution was prepared consisting of 100.00 g of a 10.0% solution of Air Products Surfynol® 465, 75.00 g of 10 wt % solution of 2,3-dihydroxy-1,4-dioxane (DHD) obtained from Aldrich Chemicals to obtain a final hardener concentration of 0.75 wt %, and additional deionized water for a total of 1000 g. The pigmented ink image was submerged in this solution for approximately 5 seconds and allowed to dry.

Excellent waterfastness properties were observed in the 100% fill areas (94% density retention). Excellent wet adhesion properties were observed in the 100% fill areas ($D_{max}$)(95% retention), and in the lower density areas (98% retention).

Example 3

An ink was prepared and printed in the same manner as that described in Comparative Example A, except to the ink-receiving layer was added 2,3-dihydroxy-1,4-dioxane (DHD) obtained from Aldrich Chemicals at a concentration of 0.50 weight percent to total ink-receiving layer polymer.

A hardener solution was prepared consisting of 100.00 g of a 10.0% solution of Air Products Surfynol® 465, 20.27 g of 37 wt % solution of formaldehyde (FA) obtained from Aldrich Chemicals to obtain a final hardener concentration of 0.75 wt %, and additional deionized water for a total of 1000 g. The pigmented ink image was submerged in this solution for approximately 5 seconds and allowed to dry.

Very good waterfastness properties were observed in the 100% fill areas (91% density retention). Excellent wet adhesion properties were observed in the 100% fill areas ($D_{max}$)(93% retention), and in the lower density areas (96% retention).

Example 4

An ink was prepared and printed in the same manner as that described in Comparative Example B, except to the ink-receiving layer was added 2,3-dihydroxy-1,4-dioxane (DHD) obtained from Aldrich Chemicals at a concentration of 0.50 weight percent to total ink-receiving layer polymer.

A hardener solution was prepared consisting of 100.00 g of a 10.0% solution of Air Products Surfynol® 465, 20.27 g of 37 wt % solution of formaldehyde (FA) obtained from Aldrich Chemicals to obtain a final hardener concentration of 0.75 wt %, and additional deionized water for a total of 1000 g. The pigmented ink image was submerged in this solution for approximately 5 seconds and allowed to dry.

Excellent waterfastness properties were observed in the 100% fill areas (99% density retention). Excellent wet adhesion properties were observed in the 100% fill areas ($D_{max}$)(97% retention), and in the lower density areas (100% retention).

Example 5

An ink was prepared and printed in the same manner as that described in Comparative Example B, except to the ink-receiving layer was added 2,3-dihydroxy-1,4-dioxane (DHD) obtained from Aldrich Chemicals at a concentration of 0.50 weight percent to total ink-receiving layer polymer.

A hardener solution was prepared consisting of 100.00 g of a 10.0% solution of Air Products Surfynol® 465, 416.7 g of a 1.80 wt % solution of bis-(vinylsulfonyl)-methane (BVSM) to obtain a final hardener concentration of 0.75 wt %, and additional deionized water for a total of 1000 g. The pigmented ink image was submerged in this solution for approximately 5 seconds and allowed to dry.

Excellent waterfastness properties were observed in the 100% fill areas (93% density retention). Excellent wet adhesion properties were observed in the 100% fill areas ($D_{max}$)(92% retention), and good wet adhesion properties was observed in the lower density areas (82% retention).

Example 6

An ink was prepared and printed in the same manner as that described in Comparative Example B, except to the ink-receiving layer was added 2,3-dihydroxy-1,4-dioxane (DHD) obtained from Aldrich Chemicals at a concentration of 0.50 weight percent to total ink-receiving layer polymer.

A hardener solution was prepared consisting of 100.00 g of a 10.0% solution of Air Products Surfynol® 465, 18.75 g of a 40 wt % solution of glyoxal obtained from Aldrich Chemicals to obtain a final hardener concentration of 0.75 wt %, and additional deionized water for a total of 1000 g. The pigmented ink image was submerged in this solution for approximately 5 seconds and allowed to dry.

Good waterfastness properties were observed in the 100% fill areas (85% density retention). Good wet adhesion properties were observed in the 100% fill areas ($D_{max}$)(84% retention), and very good wet adhesion properties (92% retention) was observed in the lower density areas.

Example 7

An ink was prepared and printed in the same manner as that described in Comparative Example B, except to the ink-receiving layer was added 2,3-dihydroxy-1,4-dioxane (DHD) obtained from Aldrich Chemicals at a concentration of 0.50 weight percent to total ink-receiving layer polymer.

A hardener solution was prepared consisting of 100.00 g of a 10.0% solution of Air Products Surfynol® 465, 16.67 g of a 45% solution of a cyclic urea glyoxal condensate consisting of 1 cyclic urea unit: 1 glyoxal unit (SUNREZ® 700 obtained from Sequa Chemicals, Inc.) to obtain a final hardener concentration of 0.75 wt %, and additional deionized water for a total of 1000 g. The pigmented ink image was submerged in this solution for approximately 5 seconds and allowed to dry.

Excellent waterfastness properties were observed in the 100% fill areas (93% density retention). Good wet adhesion properties were observed in the 100% fill areas ($D_{max}$)(90% retention), and excellent wet adhesion properties (98% retention) was observed in the lower density areas.

Example 8

An ink was prepared and printed in the same manner as that described in Comparative Example B, except to the ink-receiving layer was added 2,3-dihydroxy-1,4-dioxane (DHD) obtained from Aldrich Chemicals at a concentration of 0.50 weight percent to total ink-receiving layer polymer.

A hardener solution was prepared consisting of 100.00 g of a 10.0% solution of Air Products Surfynol® 465, 75.00 g of 10 wt % solution of 2,3-dihydroxy-1,4-dioxane (DHD) obtained from Aldrich Chemicals to obtain a final DHD concentration of 0.75 wt %, 30 g of a 25 wt % solution of aluminum sulfate ($Al_2(SO_4)_3$ $18H_2O$) to obtain a final aluminum sulfate of 0.75 wt %, and additional deionized water for a total of 1000 g. The pigmented ink image was submerged in this solution for approximately 5 seconds and allowed to dry.

Very good waterfastness properties were observed in the 100% fill areas (91% density retention). Very good wet adhesion properties were observed in the 100% fill areas ($D_{max}$)(91% retention), and good wet adhesion properties (84% retention) was observed in the lower density areas.

Ink Characterization

The images printed from the examples were evaluated by measuring the optical densities in three area patches with maximum ink coverage, and averaging, using an X-Rite™ Photographic Densitometer.

Waterfastness was determined by immersing samples of printed images in distilled water for 1 hour and then allowed to dry for at least 12 hours. The optical density was measured before immersion in water and after immersion in water and drying. Waterfastness is determined as the per cent of retained optical density in an undisturbed $D_{max}$ area after immersion in water and drying.

After the samples had been immersed in water for half an hour, a portion of each patch ($D_{max}$ and 0.40 density patch) were physically rubbed to ascertain if the pigmented ink image would rub off with pressure (wet adhesion). Wet adhesion is determined as the percent of retained optical density in the rubbed portion relative to the original density.

Results for Comparative Examples A–F and Examples 1–9 are summarized in the following Table 1.

TABLE 1

| Example | Receiver Hardener/ Amount(wt %) | Solution Hardener/ Amount(wt %) | $D_{max}$ Density Before Soak | Waterfastness (% Density Retained) | Wet Adhesion ($D_{max}$) (% Density Retained) | Wet Adhesion (Mid-Density) (% Density Retained) |
|---|---|---|---|---|---|---|
| Comp. A | None | None | 1.14 | 0 | 0 | 0 |
| Comp. B | None | None | 1.24 | 0 | 0 | 0 |
| Comp. C | DHD/0.50% | None | 1.22 | 92 | 65 | 0 |
| Comp. D | DHD/0.50% | None | 1.33 | 115 | 66 | 0 |
| Comp. E | None | DHD/0.75% | 0.99 | 87 | 0 | NG |
| Comp. F | None | DHD/0.75% | 1.41 | 98 | 0 | NG |
| 1 | DHD/0.50% | DHD/0.75% | 1.25 | 86 | 83 | 100 |
| 2 | DHD/0.50% | DHD/0.75% | 1.68 | 94 | 95 | 98 |
| 3 | DHD/0.50% | FA/0.75% | 1.21 | 91 | 93 | 96 |
| 4 | DHD/0.50% | FA/0.75% | 1.61 | 99 | 97 | 100 |
| 5 | DHD/0.50% | BVSM/0.75% | 1.57 | 93 | 92 | 82 |
| 6 | DHD/0.50% | glyoxal/0.75% | 1.60 | 85 | 84 | 92 |

TABLE 1-continued

| Example | Receiver Hardener/ Amount(wt %) | Solution Hardener/ Amount(wt %) | $D_{max}$ Density Before Soak | Waterfastness (% Density Retained) | Wet Adhesion ($D_{max}$) (% Density Retained) | Wet Adhesion (Mid-Density) (% Density Retained) |
|---|---|---|---|---|---|---|
| 7 | DHD/0.50% | SunRez 700M/0.75% | 1.58 | 93 | 70 | 98 |
| 8 | DHD/0.50% | DHD + AlS/0.75% + 0.75% | 1.65 | 91 | 91 | 84 |

DHD = 1,4-dioxane-2,3-diol, FA = formaldehyde, BVSM = bis-(vinylsulfonyl)-methane, SunRez 700M = Sequa Chemicals Blocked Aldehyde, AlS = aluminum sulfate ($Al_2(SO_4)_3$ $18H_2O$)

The results indicate that significant enhancement of wet adhesion is achieved when hardener is added to an ink receiving layer, the ink receiving layer is printed with a pigmented ink, and the printed image is treated with a hardener solution.

The invention has been described in detail with particular reference to certain preferred embodiments thereof, but it will be understood that variations and modifications can be effected within the spirit and scope of the invention.

What is claimed is:

1. A method of improving the durability of an ink jet ink image comprising the following steps in order:

a) providing an ink jet ink receiving layer containing acetoacetylated poly(vinyl alcohol) and a hardener;

b) image-wise depositing pigment-based ink jet ink on the hardener-containing ink receiving layer; and then c) applying to the ink receiving layer a solution comprising a hardener that is the same or different from the hardener in the ink receiving layer.

2. The method of claim 1 wherein the solution is applied only to areas of the receiving layer bearing an image.

3. The method of claim 1 wherein the solution is applied to imaged and non-imaged areas of the receiving layer.

4. The method of claim 1 wherein each said hardener is selected from the group consisting of organic compounds with aldehyde functional groups, blocked aldehyde functional groups, and active olefinic functional groups; inorganic compounds; and combinations thereof.

5. The method of claim 4 wherein each said hardener is an organic compound selected from formaldehyde and dialdehydes.

6. The method of claim 5 wherein said dialdehyde is selected from the group consisting of the homologous series of dialdehydes ranging from glyoxal to adipaldehyde; diglycolaldehyde; and aromatic dialdehydes.

7. The method of claim 5 wherein said dialdehyde is selected from the group consisting of glutaraldehyde, succinaldehyde, and glyoxal.

8. The method of claim 4 wherein each said hardener is selected from the group consisting of blocked dialdehydes and N-methylol compounds.

9. The method of claim 8 wherein said hardener is selected from the group consisting of 2,3-dihydroxy-1,4-dioxane, tetrahydro-4-hydroxy-5-methyl-2(1H)-pyrimidinone polymers, polymers having a glyoxal polyol reaction product consisting of 1 anhydroglucose unit: 2 glyoxal units; DME-Melamine non-formaldehyde resins; N-methylol compounds obtained from the condensation of formaldehyde with various aliphatic or cyclic amides, ureas, and nitrogen heterocycles.

10. The method of claim 8 wherein said hardener is 2,3-dihydroxy-1,4-dioxane.

11. The method of claim 4 wherein each said hardener is selected from the group consisting of active olefins and blocked active olefins.

12. The method of claim 11 wherein said hardener is selected from the group consisting of divinyl ketone; resorcinol bis(vinylsulfonate); 4,6-bis(vinylsulfonyl)-m-xylene; bis(vinylsulfonylalkyl)ethers and amines; 1,3,5-tris (vinylsulfonyl)hexahydro-striazine; diacrylamide; 1,3-bis (acryloyl)urea; N,N'-bismaleimides; bisisomaleimides; bis (2-acetoxyethyl)ketone; 1,3,5-triacryloylhexahydro-striazine; bis(2-acetoxyethyl)ketone and 3,8-dioxodecane-1, 10-bis(pyridinium perchlorate).

13. The method of claim 11 wherein said hardener is bis-(vinylsulfonyl)-methane or bis(vinylsulfonylmethyl) ether.

14. The method of claim 4 wherein the hardener in the solution is an inorganic compound selected from the group consisting of zirconium and titanium salts; chromium salts; and aluminum salts.

15. The method of claim 14 wherein the hardener is selected from the group consisting of aluminum sulfate and chrome alum.

16. The method of claim 1 wherein the concentration of hardener in the solution and in the receiver is between 0.10 and 5.0 weight percent of active ingredients in the solution and in the receiver.

17. The method of claim 1 wherein the concentration of hardener in the solution and in the receiver is between 0.25 and 2.0 weight percent of active ingredients in the solution and in the receiver.

18. An ink jet receiving layer treated according to the method of claim 1.

19. The method of claim 4 wherein the hardener in the solution is a combination of an organic compound selected from organic compounds with aldehyde functional groups, blocked aldehyde functional groups, and active olefinic functional groups and an inorganic compound selected from the list recited in claim 14.

20. An ink jet ink receiver comprising:

a support;

on the support, an ink jet ink receiving layer containing acetoacetylated poly(vinyl alcohol) and a hardener;

on the ink receiving layer, an image formed by pigmented ink jet ink deposited thereon; and a solution applied to the ink receiving layer, said solution comprising a hardener that is the same or different from the hardener in the ink receiving layer.

21. The ink jet ink receiver of claim 20 wherein the solution is applied only to areas of the receiving layer bearing the image.

22. The ink jet ink receiver of claim 20 wherein the solution is applied to imaged and non-imaged areas of the receiving layer.

* * * * *